US009243363B2

(12) United States Patent
Rosa et al.

(10) Patent No.: US 9,243,363 B2
(45) Date of Patent: Jan. 26, 2016

(54) IRONING SYSTEM WITH IRON AND MACHINE BODY SEPARABLE

(71) Applicant: DE' LONGHI APPLIANCES S.R.L. DIVISIONE COMMERCIALE ARIETE, Campi Bisenzio (IT)

(72) Inventors: Carlo Rosa, Lecco (IT); Michele Picchi, Pontedera (IT); Simone Berretti, Prato (IT)

(73) Assignee: De' Longhi Appliances S.r.l. Divisione Commerciale Ariete, Campi Bisenzio, Province of Florence (IT)

( * ) Notice: Subject to any disclaimer, the term of this patent is extended or adjusted under 35 U.S.C. 154(b) by 0 days.

(21) Appl. No.: 14/399,451

(22) PCT Filed: May 8, 2013

(86) PCT No.: PCT/EP2013/059668
§ 371 (c)(1),
(2) Date: Nov. 6, 2014

(87) PCT Pub. No.: WO2013/167700
PCT Pub. Date: Nov. 14, 2013

(65) Prior Publication Data

US 2015/0176196 A1 Jun. 25, 2015

(30) Foreign Application Priority Data

May 10, 2012 (IT) ..... GE2012A0049
Dec. 4, 2012 (IT) ..... GE2012A0115

(51) Int. Cl.
*D06F 75/12* (2006.01)
*D06F 75/32* (2006.01)

(Continued)

(52) U.S. Cl.
CPC ..... *D06F 75/32* (2013.01); *A47L 9/246* (2013.01); *D06F 75/06* (2013.01); *D06F 75/12* (2013.01); *D06F 75/28* (2013.01); *H01R 13/005* (2013.01); *D06F 75/26* (2013.01); *D06F 79/023* (2013.01)

(58) Field of Classification Search
CPC ..... D06F 75/06; D06F 75/12; D06F 75/28; D06F 75/32; D06F 75/40; D06F 79/02; D06F 79/023; D06F 79/026; H05B 1/0255; H05B 3/06; H05B 3/08; H01R 13/02; H01R 13/10; H01R 13/005; A47L 9/00; A47L 9/24; A47L 9/242; A47L 9/246
USPC ..... 38/77.6, 96, 79, 142; 219/247
See application file for complete search history.

(56) References Cited

U.S. PATENT DOCUMENTS 3,972,578 A * 8/1976 Reynolds ..... A47L 9/246 174/47
6,061,935 A * 5/2000 Lee ..... D06F 75/30 38/77.6
8,615,908 B2 * 12/2013 Collinson ..... D06F 75/12 38/77.6

(Continued)

FOREIGN PATENT DOCUMENTS

CH 684198 A5 * 7/1994
DE 19528541 A1 * 2/1996

(Continued)

OTHER PUBLICATIONS

International Search Report and Written Opinion for International Application No. PCT/EP2013/059668; Jun. 13, 2013; 9 pages.

*Primary Examiner* — Ismael Izaguirre
(74) *Attorney, Agent, or Firm* — Stetina Brunda Garred & Brucker

(57) ABSTRACT

Ironing system comprising an iron, a machine body provided with steam generating means, a tube for sending steam from the machine body to the iron and an electrical cable for supplying the iron; said steam tube and said electrical cable coming from the iron comprise a first connector suitable to be connected, according to a first operating mode of the system, to a second connector connected to a portion of steam tube inside the machine body and to conductors of said electrical cable inside the machine body; in said first and second connectors there are provided electrical contact elements suitable to cooperate with one another and to enable contact of said electrical conductors with said electrical cable and valve means suitable to enable connection of said portion of tube with said tube to enable the passage of steam from the machine body to the iron; said first connector is connectable, according to a further operating mode of the system, directly with an electrical supply cable connectable to the electricity distribution system thus excluding the machine body.

19 Claims, 7 Drawing Sheets

(51) Int. Cl.

| | |
|---|---|
| ***A47L 9/24*** | (2006.01) |
| ***H01R 13/00*** | (2006.01) |
| ***D06F 75/28*** | (2006.01) |
| ***D06F 75/06*** | (2006.01) |
| *D06F 79/02* | (2006.01) |
| *H01R 13/02* | (2006.01) |
| *D06F 75/26* | (2006.01) |

(56) References Cited

U.S. PATENT DOCUMENTS

2002/0119707 A1* 8/2002 Morgan ..... H01R 13/005 439/660
2002/0157288 A1* 10/2002 Valiyambath ..... D06F 75/02 38/85
2003/0208872 A1* 11/2003 Tsen ..... A47L 11/34 15/321
2008/0034623 A1 2/2008 Rosenzweig

FOREIGN PATENT DOCUMENTS

EP 0135484 A2 * 3/1985
EP 0574602 A1 * 12/1993
EP 0618324 A1 * 10/1994
JP 04073099 A * 3/1992
WO WO0006945 * 2/2000
WO WO02081810 10/2002

* cited by examiner

IRONING SYSTEM WITH IRON AND MACHINE BODY SEPARABLE

CROSS REFERENCE TO RELATED APPLICATIONS

The present application claims priority to PCT International Application No. PCT/EP2013/059668 filed on May 8, 2013, which claims priority to Italian Patent Application No. GE2012A000049 filed May 10, 2012 and Italian Patent Application No. GE2012A000115 filed Dec. 4, 2012, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

The present invention relates to an ironing system.

Conventional ironing systems are essentially composed of an iron and of a machine body connected indissolubly and inseparably by means of an electrical cable and a steam tube. This machine body comprises therein steam generation means, for example a boiler, associated with a solenoid valve suitable to enable delivery of these means toward the iron. This solenoid valve is controlled by a switch operable by a button positioned on the box body of the iron and pressed by the user during normal ironing operations. The iron normally has a soleplate provided with holes for output of the steam and an electrical heating element for heating the soleplate.

The fact that the machine body and the iron are connected indissolubly to each other by means of this electrical cable and by means of this steam delivery tube represents a substantial limitation to these systems; in fact the iron can only be used when the machine body is switched on and therefore, even for small ironing operations, the whole ironing system, which is generally relatively bulky and heavy, must be moved. The fact that the iron must always be used connected to the machine body also leads to substantial consumptions of electricity, even in cases in which only smaller amounts would be necessary. Moreover, in the event of a fault in the machine body or in the iron, the user generally requires to replace the whole ironing system.

SUMMARY OF THE INVENTION

Therefore, the object of the present invention is to produce an ironing system that can function according to two operating modes, i.e. a first mode in which the iron is connected to the machine body and a second mode in which the iron can be separated from the machine body and can be used separately therefrom, for example for small ironing operations in which the use of the machine body is not essential.

This object is achieved by the present invention through an ironing system with iron and machine body separable according to claim 1.

In a variant of embodiment of the invention, the present ironing system comprises a single junction box in which there are housed both the connection means for supplying power to the iron and the connection means with a socket of the machine body containing the electrical connectors and the vale means for sending steam to the iron. This junction box is also connected to the normal electrical power supply cable, which is in any case connected to the normal electricity supply system.

In this way, through a single operation the user can choose to use the iron coupled to the machine body, connecting the junction box to the machine body, to collect steam and supply electricity to the iron through this machine body, or the iron can be used alone with the junction box disconnected from the machine body and the electrical cable to which it is connected, as stated, connected to a normal power socket.

Other important features of the present invention form the subject matter of the dependent claims.

BRIEF DESCRIPTION OF THE DRAWINGS

Further features and advantages of the present invention will be better understood from the following description, to be considered purely by way of non-limiting example and with reference to the accompanying drawings, wherein.

DETAILED DESCRIPTION OF THE INVENTION

Figure 1:
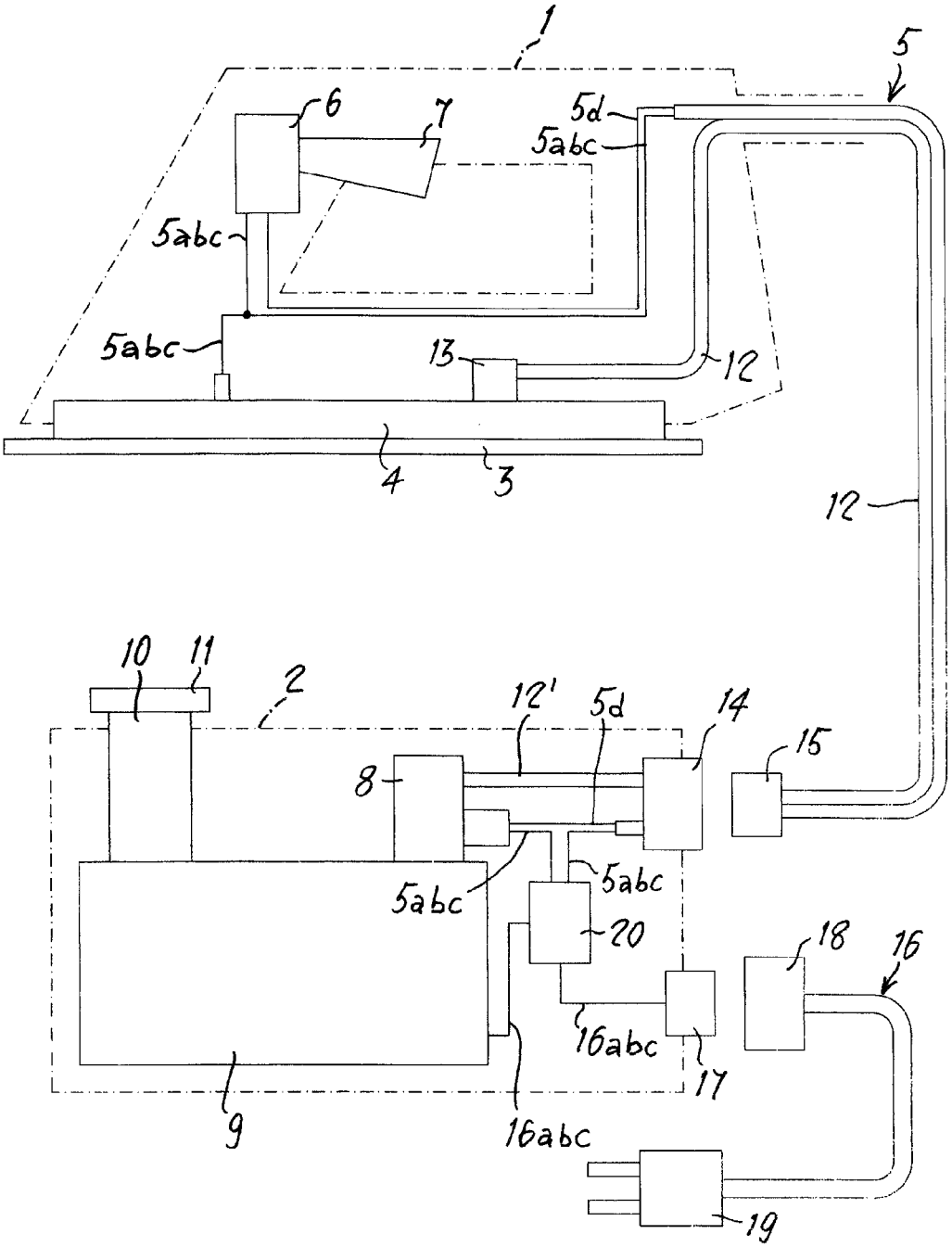
FIG. 1 illustrates a schematic view of a first embodiment of an ironing system with iron separable from the machine body according to the present invention.

With reference to the accompanying drawings and with particular reference to FIG. 1 thereof, the numbers 1 and 2 indicate respectively an iron and a machine body of an ironing system according to the present invention. The iron 1 comprises at the bottom a soleplate 3 for delivering steam provided with a series of small holes, not visible in the figure. Above the soleplate 3 there is positioned a chamber 4 in which there are obtained a series of cavities, known per se, communicating with the steam delivery holes. This soleplate 3 will also be provided with heating means, such as a heating element or the like. The iron 1 and the machine body 2 are connectable by means of a tube 12 for sending the steam from the machine body 2 to the iron 1, and by a multicore electrical cable 5 that runs parallel to this tube 12. This electrical cable 5 and this tube 12 have a first connection plug 15, suitable to be connected with a first connection socket 14 positioned on an external wall of the machine body 2. In the iron 1 there is positioned a switch 6 controlled by a button 7 which can be operated by the user and is connectable by means of a conductor 5*d* of the multicore electrical cable 5 to a solenoid valve 8 of the machine body 2. The steam coming from the tube 12 reaches a connector 13 positioned above the chamber 4 of the iron 1. The machine body 2 comprises internally means 9 for generating steam, for example a boiler, into which water is introduced from an input channel closed at the top by a cap 11. The solenoid valve 8 controls the delivery of steam from said means 9 and is connected, through a portion 12' of tube, to the first connection socket 14 positioned on the external wall of the machine body 2. On an external wall of the machine body 2 there is also positioned a second connection plug 17 suitable to engage with a second connection socket 18 positioned at one end of a three-core electrical cable 16, at the other end of which there is positioned a plug 19 for engaging with a normal socket of the electricity supply system. The multicore electrical cable 5 typical of ironing systems comprises four electrical conductors: one line conductor 5*a*, one neutral conductor 5*b*, one ground conductor 5*c* and a further return conductor 5*d*, which, as stated, connects the electrical switch 6 of the iron 1 with the solenoid valve 8. However, this multicore cable 5 could also be provided with a different number of conductors. The heating means of the iron 1 are electrically supplied by means of three electrical conductors 5*a*, 5*b*, 5*c* of the multicore electrical cable 5, illustrated schematically with a single line 5*abc*. The three conductors 5*a*, 5*b*, 5*c* are also connected to the switch 6 associated with the button 7, which can be operated by the user. Besides the portion of tube 12', to the first socket there are also connected the conductor 5*d*, which leads to the solenoid valve, and the conductors 5*a*, 5*b*, 5*c*, which are connected to a terminal strip 20 and then to the solenoid valve 8. To this terminal strip there is also connected a portion 16*abc* of the three-core electrical cable 16 connected to the second plug 17 suitable to be connected with the second socket 18. The iron 1 can be provided with a supplementary tank suitable to supply water to the chamber 4, in which this water vaporises. The arrangement of this supplementary tank for supplying water to the iron forms the subject matter of a patent application contemporaneous with this application and belonging to the holders of this latter.

Figure 2:
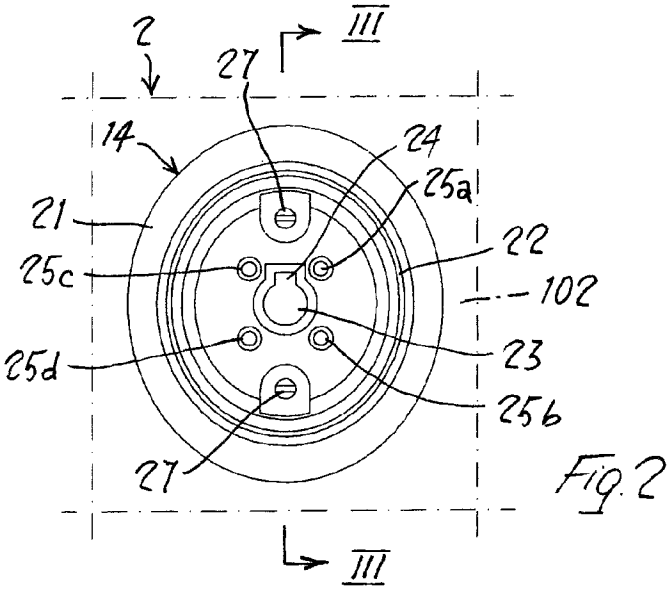
FIG. 2 illustrates a front view of a connection socket positioned on an external wall of the machine body.

FIG. 2 illustrates frontally the socket 14 positioned on an external wall 102 of the machine body 2. This socket 14 comprises a base 21 for connection to this external wall 102 and a connection seat 22. This seat 22 must enable both the electrical connection with the cable 5, and the connection for the passage of steam through the tube 12. For this purpose, in the central area of this seat 22 there is provided a tubular inlet element 23 in which, as shall be seen below, there will be inserted a further tubular element of smaller diameter of the connection plug 15 of FIG. 1. This tubular inlet element 23 comprises on the internal wall a longitudinal groove 24 for housing a longitudinal rib with which this further tubular element of the plug 15 of FIG. 1 is provided, so as to obtain a correct position for engagement of the plug 15 in the socket 14. This connection seat 22 also comprises four electrical contact bushings 25*a*, 25*b*, 25*c* and 25*d* for the related conductors 5*a*, 5*b*, 5*c* and 5*d* of the multicore cable of FIG. 1.

Figure 3:
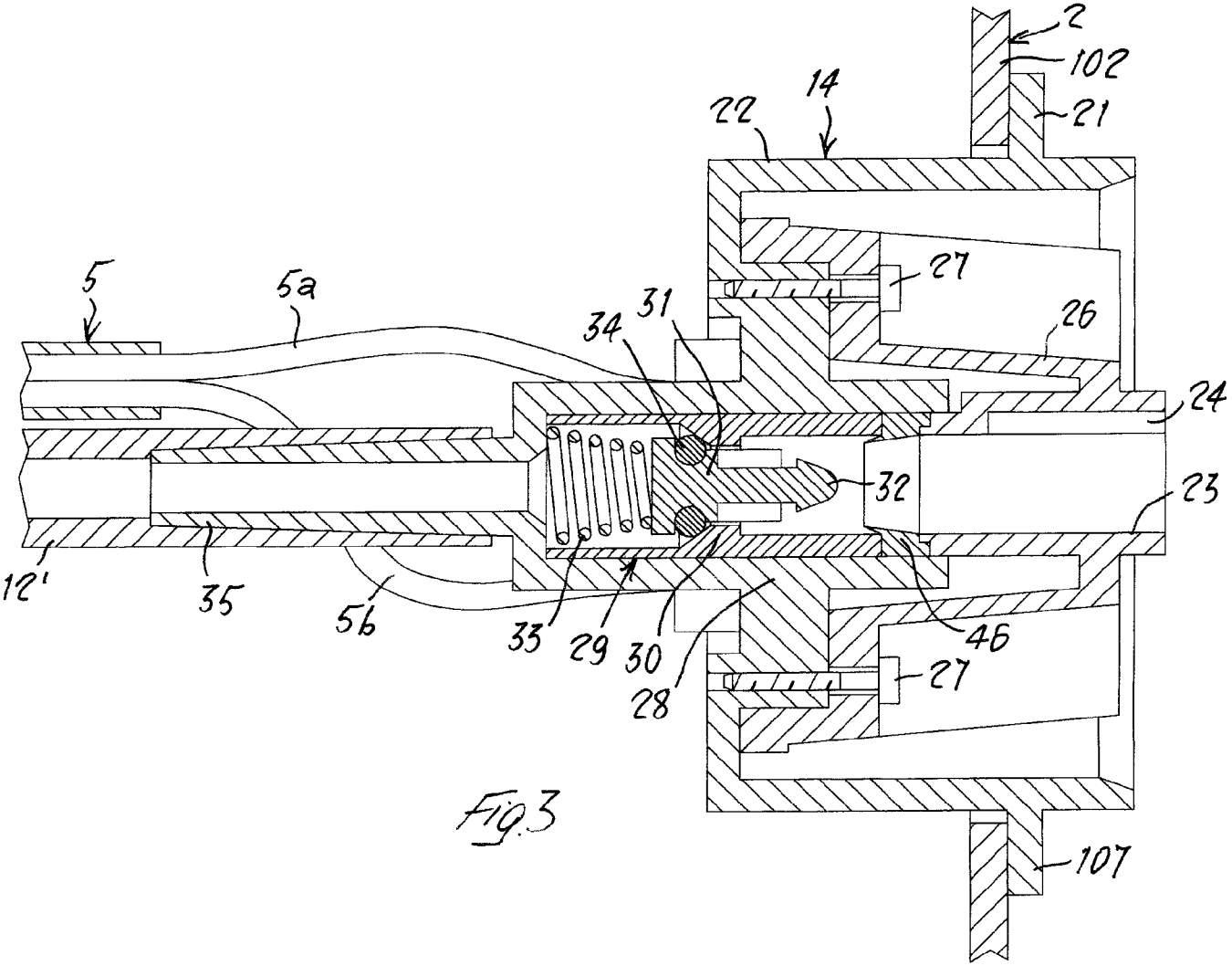
FIG. 3 illustrates a sectional view of the connection socket considered according to the line III-III of FIG. 2.

The seat 22 of the connection socket 14, see FIG. 3, is box-shaped and comprises a central inlet body 26 in which there is obtained the tubular element 23 and is connected to the seat 22 by means of screws 27. This seat 22 comprises a central housing 28 in which there is positioned a check valve 29. This valve 29 comprises a seat 30 of its own, in which there is housed a shutter 31 provided with a pin 32 facing the tubular inlet element 23. The shutter 31 is maintained in the closed position of the valve 29 by means of a spring 33 and between it and the seat 30 of the valve there is provided a sealing ring 34. The seat 22 of the socket 14 is also provided, on the opposite side with respect to the side on which the central inlet body 26 is fixed, with a tang 35 engaged in the portion 12' of steam delivery tube inside the machine body 2. Between the seat 30 of the check valve 29 and the tubular inlet element 23 there is also provided a lip seal 46.

Figure 4:
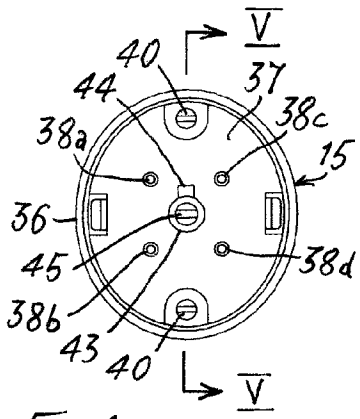
FIG. 4 illustrates a front view of a connection plug positioned at one end of the electrical cable and of the steam tube connected to the other end of the iron.
Figure 5:
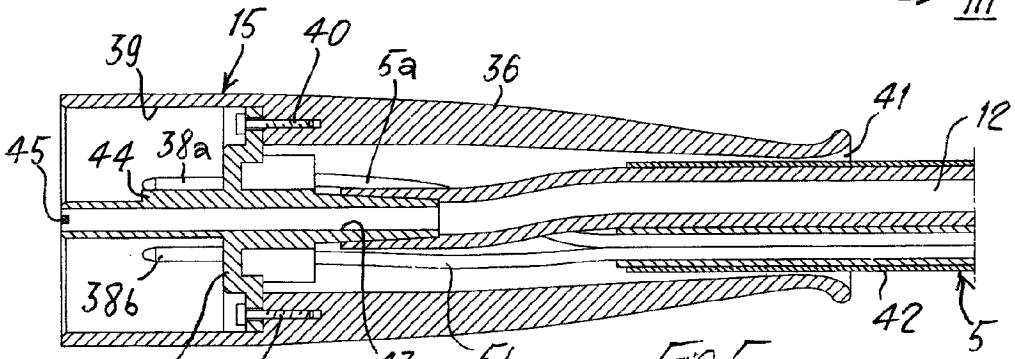
FIG. 5 illustrates a sectional view of the connection plug considered according to the line V-V of FIG. 4.

The connection plug 15, see FIGS. 4 and 5, comprises an external shell 36 and an internal contact plate 37 in which there are arranged four pins 38*a*, 38*b*, 38*c* and 38*d* respectively connected to the conductors 5*a*, 5*b*, 5*c*, 5*d* of the electrical cable 5 and suitable to engage with the bushings 25*a*, 25*b*, 25*c* and 25*d* of FIG. 2. The shell 36 is hollow inside and has on one side a seat 39 for fixing the plate 37, by means of screws 40, and, on the other side, an opening 41 for inserting the steam tube 12 and the electrical cable 5, which in FIG. 5 are inserted inside a single sheath 42. The plate 37 is provided in the centre with a pipe 43, which on one side is inserted in the steam tube 12 and on the other side reaches the height of the edge of the seat 39 and is provided on the side wall with a longitudinal rib 44 suitable to engage with the longitudinal groove 24 of the socket 14 of FIG. 3. This pipe 43 is provided at the end positioned in the seat 39 with a crossbar 45 suitable to engage with the pin 32 of the check valve 29 of FIG. 3 and to enable the passage of steam inside the pipe 43.

Figure 7:
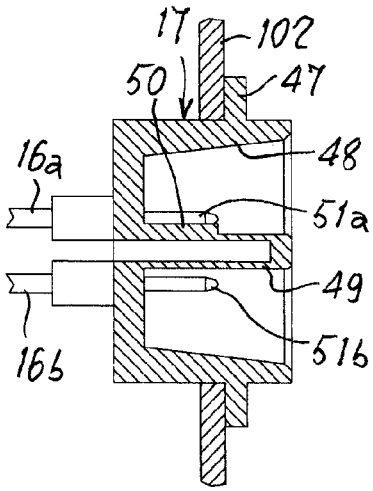
FIG. 7 illustrates a sectional view of the connection plug considered according to the line VII-VII of FIG. 6.
Figure 6:
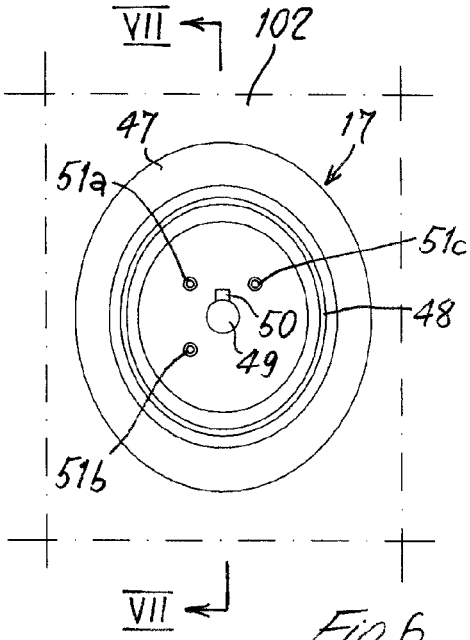
FIG. 6 illustrates a front view of a connection plug positioned on an external wall of the machine body.

The connection plug 17, see FIGS. 6 and 7, comprises a base 47 for connection with the external wall 102 of the machine body and a seat 48 provided in the centre with a spindle 49 closed at the end. On this spindle 49 there is obtained a projecting longitudinal rib 50 suitable to engage in a related longitudinal groove of the socket 18 of FIGS. 8 and 9, so as to obtain correct positioning of said plug 17 in said socket 18. In the seat 28 of the plug 17 there are provided three pins 51*a*, 51*b* and 51*c* for contact with the respective conductors 16*a*, 16*b* and 16*c* of the portion 16*abc* of three-core electrical cable 16 inside the machine body 2, see FIG. 1. With respect to the plug 15 illustrated in FIGS. 4 and 5, the plug 17 has three pins instead of four, in fact, the cable 16 is not provided with a further return conductor, as in the cable 5. Moreover as stated, in this plug 17 the spindle 49 is closed, as the passage of steam therein is not provided for.

Figure 8:
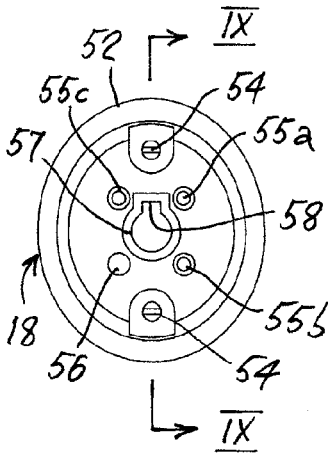
FIG. 8 illustrates a front view of a connection plug connected to one end of an electrical cable whose other end is provided with a connection plug to the electricity supply system.
Figure 9:
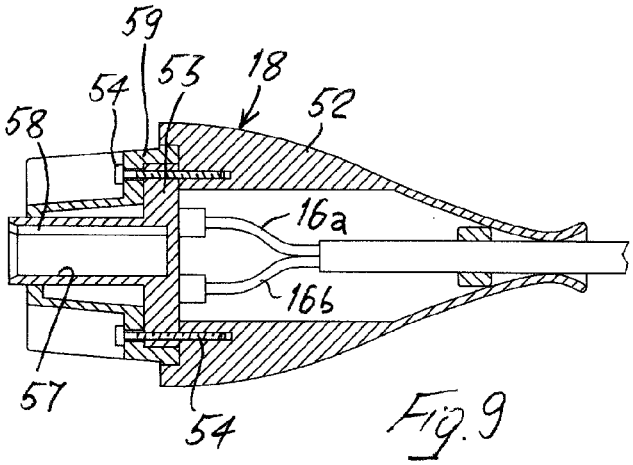
FIG. 9 illustrates a sectional view of the connection plug considered according to the line IX-IX of FIG. 8.

The connection socket 18, see FIGS. 8 and 9, comprises an external shell 52, through which the conductors 16*a*, 16*b* and 16*c* of the electrical cable 16 pass, and a plate 53 fixed to the shell by means of screws 54. On this plate there are obtained three bushings 55*a*, 55*b* and 55*c* for contact with the conductors 16*a*, 16*b* and 16*c* of the electrical cable 16 and a hole 56. This plate 53 is provided in the centre with a tubular housing 57 provided on the internal lateral wall with a longitudinal groove 58. In the connection of the plug 17 with the socket 18, the spindle 49 will be inserted in the tubular housing 57 with the related rib 50 inserted in the related longitudinal groove 58, while the pins 51*a*, 51*b* and 51*c* will engage in the bushings 55*a*, 55*b* and 55*c*.

Advantageously, the plug 18 can also be connected directly to the socket 15 of the electrical cable 5 of FIG. 1, completely excluding the machine body 2 from the iron 1. For this purpose, the plug 18 also has a case 59 connected to the plate 53, which is provided with the hole 56, so that if the plug 15, which comprises four pins 38*a*, 38*b*, 38*c* and 38*d* for the four conductors 5*a*, 5*b*, 5*c* and 5*d* of the cable 5, is connected to the socket 18, the pin 38*d*, associated with the return conductor 5*d*, in any case can be housed in said hole 56 and connection of the plug 15 with the socket 18 can be achieved.

Figure 10:
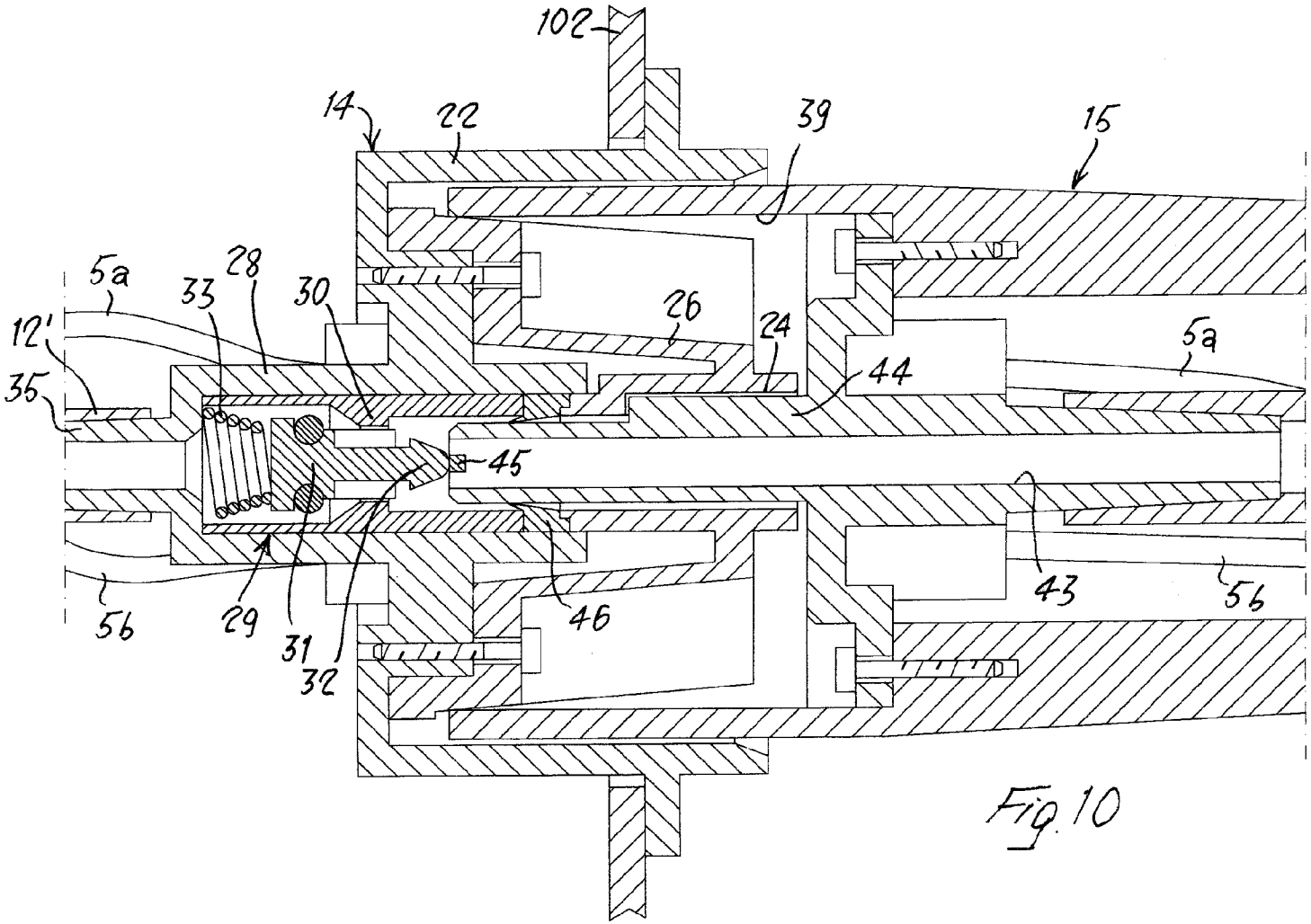
FIG. 10 illustrates a view in side elevation and longitudinal section of the connection plug of FIGS. 4 and 5 inserted in the connection socket of FIGS. 2 and 3.

According to a first operating mode of this first embodiment of the present ironing system, the iron 1 can be connected to the machine body 2 and to do this it is necessary to connect the socket of the machine body 2 with the plug 15 of the electrical cable 5. This situation is illustrated in FIG. 10. By inserting the plug 15 in the socket 14 the pipe 43 is inserted in the tubular inlet element 24 and the crossbar 45 with which it is provided at the end presses on the pin 32 of the shutter 31 of the valve 29 so that it translates opposing the action of the spring 33 and opens the passage of the seat 30 of the valve 29. Simultaneously, the pins of the plug 15, visible in FIG. 4, will engage with the bushings of the socket 17 visible in FIG. 2, so that the electrical cable 5 is connected, see FIG. 1, with the line 5*abc* that symbolizes the three conductors 5*a*, 5*b*, 5*c* and with the conductor 5*d* inside the machine body 2. After having connected the plug 17 to the socket 18 and the plug 19 to the normal power socket of the electricity supply system, the user can use the present ironing system with delivery of steam from the boiler 9 of the machine body 2. This operation is implemented by operating the button 7 that closes the switch 6 and controls the solenoid valve 8 to send steam through the portion 12' of steam tube, through the plug 15 and the socket 14 of FIG. 10, in which the arrow indicates the direction of the steam, and then through the tube 12 that runs parallel to the cable 5.

If instead the user wishes to use the iron 1 separated from the machine body 2, for example to perform small ironing operations where the use of the machine body is not essential, as stated he or she proceeds to connect the plug 15 directly in the socket 18, completely isolating the machine body 2 and disconnecting it from normal electricity supply system. The iron of the present ironing system, for example for operations of greater duration, can be provided with its own supplementary water tank to generate steam in place of the steam generated by the machine body of the ironing system.

Alternatively to the description above, the plug 15 connected to the cable 5 and to the tube 18 could also be connected directly to a plug similar to the plug 19 and provided with a suitable housing, leaving the machine body connected to the electricity supply through the electrical cable 16.

Figure 11:
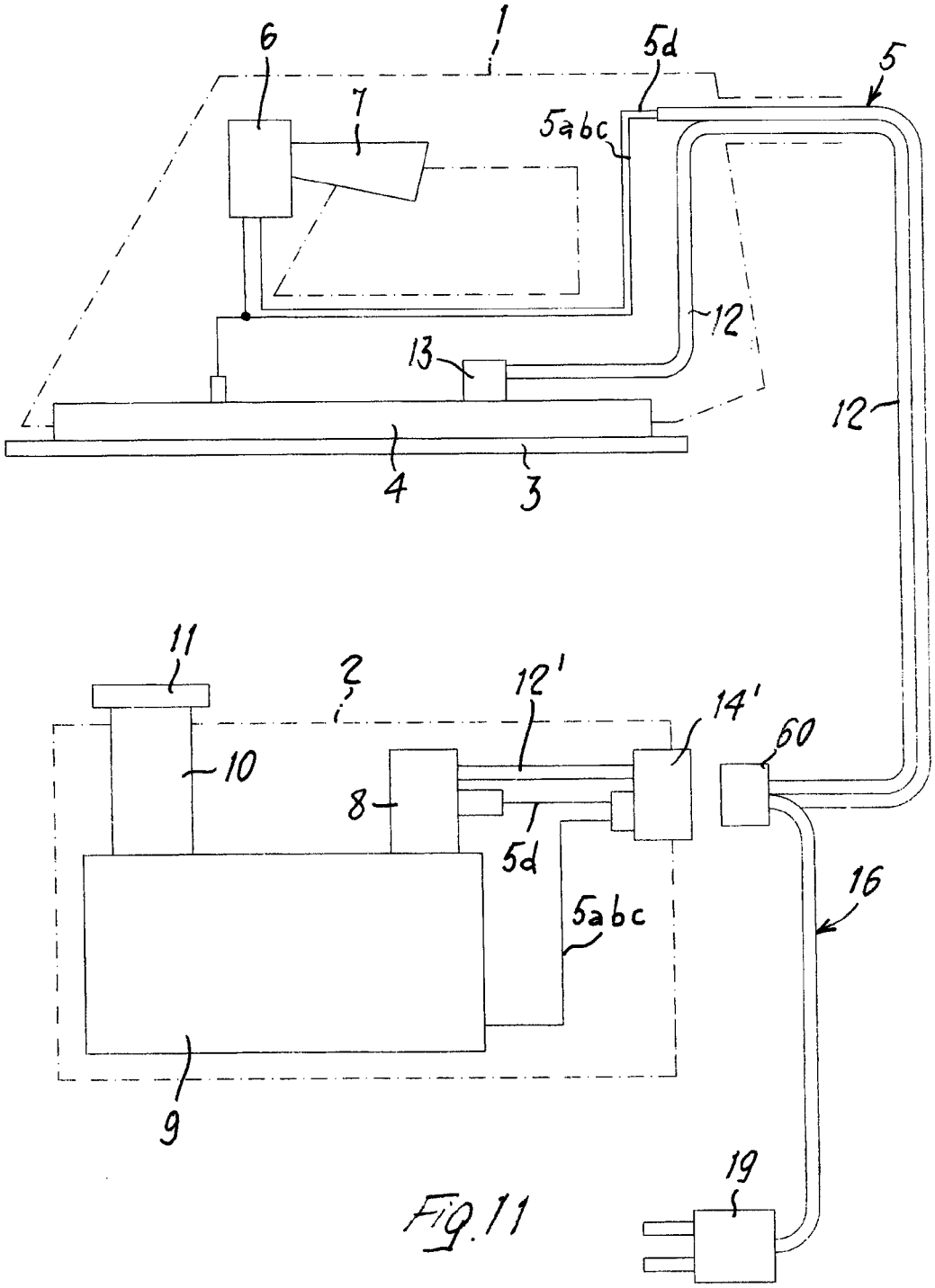
FIG. 11 illustrates a schematic view of an ironing system with iron separable from the machine body according to a variant of embodiment of the present invention and provided with a single junction box for connection or disconnection of the iron with or from the machine body.

FIG. 11 illustrates a variant of embodiment of the present ironing system. In this variant the electrical cable 5 and the tube 12 are connected to a junction box 60 suitable to be connected to a single connection socket 14' positioned on an external wall of the machine body 2. In this case the solenoid valve 8 is connected, through the portion 12' of tube, to this connection socket 14', to which there are also connected the conductor 5*d*, which leads to the solenoid valve 8, and the conductors 5*a*, 5*b*, 5*c*, which are connected to the boiler 9. Just as in the previous embodiment of the present system, the iron 1 can be provided with a supplementary tank suitable to supply water to the chamber 4, in which this water vaporises.

Figure 12:
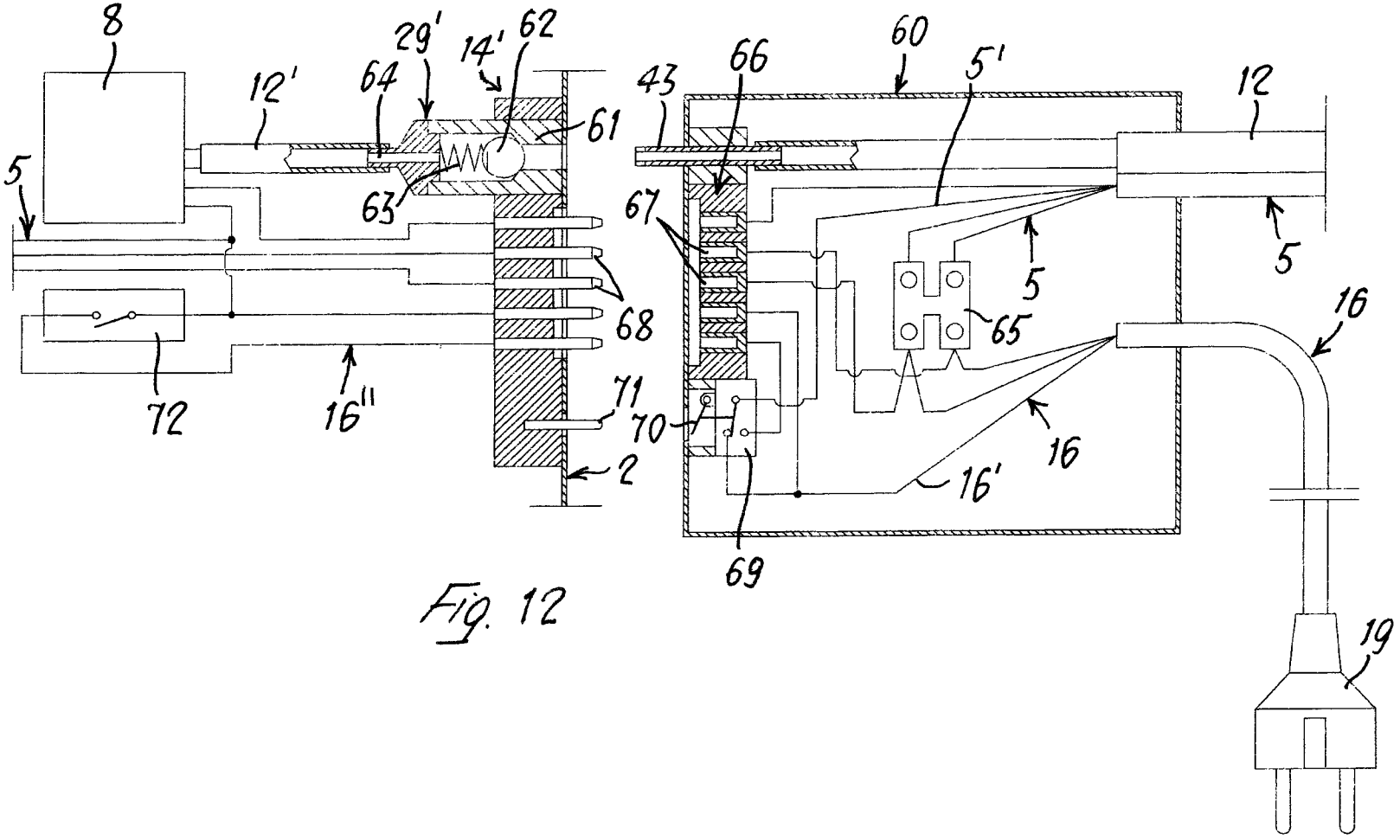
FIG. 12 illustrates a section view of the junction box of FIG. 11 and of a socket positioned on a wall of the machine body.

FIG. 12 illustrates in a sectional view the junction box 60. Inside this box 60 there is housed a portion of the steam tube 12 connected to the iron. At the end of the tube 12 there is engaged a pipe 43 projecting from the box 60 and suitable to engage in the seat 61 of a check valve 29' provided in the socket 14'. This valve 29' can be optional and is provided inside the seat 61 of a ball shutter 62 cooperating with opposing elastic means 63 which maintain it in the closed position shown in the figure. On the opposite side from that of insertion of the pipe 43, this valve 29' is provided with a tubular portion 64 inserted in the portion of tube 12' connected to the solenoid valve 8 and therefore to the boiler 9.

Inside the junction box 60 there are also illustrated the various electrical wires of the multicore electrical cable 5 coming from the iron. Without going into detail of each single electrical wire, a pair of these electrical wires of the cable 5 are connected to a terminal strip 65 and then to a connection socket 66 located on the wall of the box 60 facing the machine body and having a series of connection seats 67. These connection seats 67 are suitable to engage with related pins 68 provided in the socket 14' positioned on the wall of the machine body 2. Another wire of this cable 5 is connected directly to this socket 66 while a further wire 5' is connected to a microswitch 69 operating in two positions, as will be seen below. The cable 16 has a pair of wires connected to the terminal strip 65 and then to the socket 66 and a wire 16' connected directly to the microswitch 69. The microswitch 69 is connected rigidly to a lug 70 suitable to be engaged mechanically by a pin 71 projecting from the wall of the machine body 2. Inside the machine body 2 there is schematically illustrated the wiring of the cable 5, which is connected to the boiler 9 of FIG. 1 and to the solenoid valve 8, and the wiring of the cable 16, indicated as 16", which is connected to a switch 72 for switching on and off the ironing system and/or the iron 1, when the iron 1 is connected to the machine body 2 and to the solenoid valve 8.

According to this variant of embodiment of the present system, when the user wishes to use the iron disconnected from the machine body, the situation is as illustrated in FIGS. 11 and 12, i.e. the iron 1 is connected directly to a normal electrical socket via the plug 19. As mentioned, this iron can optionally be provided internally with a small water tank. As can be seen from the section of FIG. 11, the wire 5' of the multicore cable 5 is connected through the microswitch 69 to the wire 16' of the cable 16 connected to the plug 19 and then to the power socket.

Instead, if the user decides to use the iron 1 connected to the machine body 2, advantageously he or she only requires to perform a single operation, i.e. insert the junction box 60 in the socket 14' located on the lateral wall of the machine body 1: in this way the pipe 43 will push the ball shutter 62 opposing the action of the spring 63 and steam will be able to flow from the boiler to the solenoid valve 8 and then finally into the tube 12 that conveys it to the iron; the pins 68 will be inserted in the related seats 67 of the socket 66; while the pin 71 will press on the lug 70 rigidly connected to the microswitch 69. By means of the switch 6 operated by the button 7, the user requests that steam is sent from the machine body 2. The change of position of the microswitch 69 will enable the machine body 2 to be supplied with electricity, again through the cable 16 provided with plug 19, so that the iron 1 in this case will not be supplied directly with electricity, but through the machine body 2. Therefore, by changing the position of the microswitch 69 this will enable the switch-on mode of the iron to be moved from direct, as is the case with the iron disconnected, to controlled, through the switch 72 located on the machine base or body 2. To switch on the machine base or body 2 and the elements comprised therein, for example the solenoid valve 8, there is provided a further switch, not shown, which will be connected to the cable 16, and which will be operated as required by the user. To return to the situation illustrated in FIGS. 11 and 12 and use the iron 1 separated from the machine body 2, the user must only disconnect the junction box 2 from the socket 14' of the machine body 2. The lug 70 of the microswitch 69 will no longer be pressed by the pin 71 and therefore, being provided with normal elastic return means, not shown in the figure, it will return to the position of FIG. 12.

What is claimed is:

1. An ironing system, comprising an iron, a machine body provided with steam generating means, a tube for sending steam from the machine body to the iron and an electrical cable for supplying the iron, characterized in that said steam tube and said electrical cable coming from the iron comprise a first connector suitable to be connected, according to a first operating mode of the system, to a second connector connected to a portion of steam tube inside the machine body and to conductors of said electrical cable inside the machine body, there being provided in said first and second connectors electrical contact elements suitable to cooperate with one another and to enable contact of said electrical conductors with said electrical cable and also provided with valve means suitable to enable connection of said portion of tube with said tube to enable the passage of steam from the machine body to the iron, and said first connector being connectable, according to a further operating mode of the system, directly with an electrical supply cable connectable to the electricity distribution system thus excluding the machine body.

2. The ironing system according to claim 1, characterized in that said first connector is suitable to be connected with a third connector provided internally with elements for electrical contact for connection with the electrical cable and connectable to the electricity distribution system, thus excluding the machine body.

3. The ironing system according to claim 2, characterized in that said third connector comprises a central plate in which there are positioned the electrical contact elements and comprises in the centre a tubular housing suitable to receive said central pipe of the first connector.

4. The ironing system according to claim 1, characterized in that said steam tube and said electrical cable coming from the iron are connected to a single junction box also connected with said electrical supply cable connectable to the electricity distribution system and provided with a series of conductors connected to the contact elements provided in the box, so that the iron can be connected directly to the electricity distribution system excluding the machine body.

5. The ironing system according to claim 4, characterized in that said junction box comprises on the inside a microswitch for selection of said first and second operating modes, said microswitch being connected to at least one conductor of said connection cable of the machine body to the iron, to at least one conductor of said electrical supply cable from the electricity distribution system and to said electrical contact elements inside the junction box.

6. The ironing system according to claim 5, characterized in that in said connector located on the wall of the machine body there is positioned a projecting pin suitable to engage, in said first operating mode of the system, with a lug integral with the microswitch, so as to interrupt the direct connection between said conductor of the connection cable between the junction box and iron and said conductor of the electrical supply cable from the electricity distribution system.

7. The ironing system according to claim 4, characterized in that said valve means comprise a tubular pipe projecting from the junction box suitable to engage with a shutter of a check valve connected to the portion of steam tube inside the machine body, said shutter being normally maintained in closed position by related opposing elastic means.

8. The ironing system according to claim 4, characterized in that inside the junction box there is housed a terminal strip for connection of the conductors of the electrical connection cable between the iron and the junction box with the conductors of the electrical supply cable from said electricity distribution system.

9. The ironing system according to claim 1, characterized in that it comprises a fourth connector positioned on the machine body and suitable to be connected with said third connector, said fourth connector being provided with electrical contact elements suitable to engage with the electrical contact elements of said third connector and said third connector being connected to an electrical power supply cable.

10. The ironing system according to claim 9, characterized in that said fourth connector comprises a box seat in which there are housed the electrical contact elements and, centrally, a spindle suitable to engage in a tubular housing obtained on said third connector.

11. The ironing system according to claim 9, characterized in that said second and fourth connectors comprise a base suitable to be connected with an external wall of the machine body.

12. The ironing system according to claim 1, characterized in that said first connector comprises an external shell and an internal plate in which there are positioned the electrical contact elements, said plate being provided with a central pipe connectable on one side with said tube for the passage of steam and on the other side suitable to cooperate with said valve means of the second connector.

13. The ironing system according to claim 1, characterized in that said second connector comprises a seat provided with said electrical contact elements and in which there is housed a check valve, said seat being provided on one side with a tang suitable to engage with the portion of tube for the passage of steam inside the machine body and connected with said steam generation means.

14. The ironing system according to claim 13, characterized in that said seat is substantially box shaped and comprises on the side opposite the side on which the tang is positioned a tubular inlet element coaxial to the seat of the valve and in contact with this latter through sealing means.

15. The ironing system according to claim 14, characterized in that said tubular inlet element is obtained on a central body fixed in a removable manner to the seat of the second connector.

16. The ironing system according to claim 13, characterized in that said check valve housed in the seat of the second connector comprises a shutter provided with a projecting pin suitable to engage with said central pipe of the first connector inserted in said tubular inlet element of the second connector.

17. The ironing system according to claim 16, characterized in that said central pipe comprises at the end a crossbar suitable to engage with said projecting pin of the shutter.

18. The ironing system according to claim 1, characterized in that said connectors can be coupled in a single position by means of a longitudinal rib obtained on the outside of a projecting element of a connector and suitable to engage in a longitudinal groove obtained in a housing of another related connector, or vice versa.

19. The ironing system according to claim 1, characterized in that inside the machine body the wiring conductors of the cable for optional connection of the iron to the machine body are connected to a solenoid valve for delivering steam to said steam generating means, while the wiring conductors of said electrical supply cable from the electricity distribution system are connected to a switch for switching on and off the iron and/or the ironing system and to said solenoid valve.

* * * * *